US009770879B2

(12) United States Patent
Kosse

(10) Patent No.: US 9,770,879 B2
(45) Date of Patent: Sep. 26, 2017

(54) PRESS DRIVE WITH SEVERAL MODES OF OPERATING A PRESS AND METHOD FOR OPERATING A PRESS DRIVE

(71) Applicant: Marcus Kosse, Heiningen (DE)

(72) Inventor: Marcus Kosse, Heiningen (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 964 days.

(21) Appl. No.: 13/839,506

(22) Filed: Mar. 15, 2013

(65) Prior Publication Data

US 2013/0247698 A1 Sep. 26, 2013

(30) Foreign Application Priority Data

Mar. 23, 2012 (DE) ..... 10 2012 102 525

(51) Int. Cl.
*B30B 15/00* (2006.01)
*B30B 1/14* (2006.01)
*B30B 13/00* (2006.01)

(52) U.S. Cl.
CPC ..... *B30B 15/0023* (2013.01); *B30B 1/14* (2013.01); *B30B 13/00* (2013.01); *B30B 15/0029* (2013.01); *B30B 15/0041* (2013.01); *Y10T 74/18184* (2015.01)

(58) Field of Classification Search
CPC .... B30B 1/06; B30B 1/10; B30B 1/14; B30B 1/268; B30B 15/0029; B30B 15/0041; B30B 15/0023; B30B 13/00; Y10T 83/8845; Y10T 83/8843; Y10T 74/1816; Y10T 74/18184; B26D 5/18; B21J 9/18
USPC ..... 100/280, 281, 282; 72/446, 450, 451, 72/452.5; 83/628, 630
See application file for complete search history.

(56) References Cited

U.S. PATENT DOCUMENTS 2,784,665 A * 3/1957 Georgeff ..... B30B 1/14 100/259
3,124,019 A * 3/1964 Chatfield ..... B21J 9/18 100/281
3,785,282 A * 1/1974 Kamelander ..... B30B 1/14 100/257

(Continued)

FOREIGN PATENT DOCUMENTS

DE 15 52 658 A 9/1971
DE 199 35 656 A1 2/2001

(Continued)

*Primary Examiner* — Jimmy T Nguyen
(74) *Attorney, Agent, or Firm* — R. S. Lombard; K. Bach

(57) ABSTRACT

A press drive for a press includes an elbow lever drive. The elbow lever drive includes a first lever, a second lever and a connecting rod. The lengths of the two levers as well as the connecting rod are fixed. The first lever is pivotally supported on the press frame by a first support bearing. The second lever is supported on the plunger via a second support bearing. The connecting rod and the two levers are supported by an elbow joint so as to be pivotable relative to each other about a common pivot axis. The connecting rod is driven by an eccentric drive. An adjustment arrangement is provided for moving the eccentric drive relative to the press frame or respectively, the first support bearing. In this way, different operating modes can be established depending on the position of the eccentric drive along the adjustment path.

16 Claims, 9 Drawing Sheets

(56) References Cited

U.S. PATENT DOCUMENTS

| | | | | | |
|---|---|---|---|---|---|
| 4,434,646 | A * | 3/1984 | Maeda | B21J 9/18 | 100/231 |
| 5,321,969 | A * | 6/1994 | Bakermans | B21D 28/002 | 100/257 |
| 5,916,345 | A * | 6/1999 | Kobayashi | B30B 1/10 | 100/272 |
| 6,871,586 | B2 * | 3/2005 | Teraoka | B21J 9/18 | 100/257 |

FOREIGN PATENT DOCUMENTS

| | | | |
|---|---|---|---|
| DE | 100 47 729 | A1 | 4/2002 |
| DE | 10 2006 056 520 | A1 | 6/2008 |
| EP | 1 946 917 | A2 | 7/2008 |

* cited by examiner

PRESS DRIVE WITH SEVERAL MODES OF OPERATING A PRESS AND METHOD FOR OPERATING A PRESS DRIVE

CROSS-REFERENCE TO RELATED APPLICATION

This application claims the priority benefits of German Application No. 10 2012 102 525.8 filed Mar. 23, 2012.

BACKGROUND OF THE INVENTION

The invention resides in a press drive for a press as well as in a method for operating the press. The press drive includes an elbow lever drive. The elbow lever drive is driven by an eccentric drive and serves for coupling the eccentric drive with the plunger of the press so as to move it in the stroke direction.

Presses with elbow lever drives are generally known. DE 10 2005 001 878 B3 discloses a press drive with an elbow lever drive, wherein an auxiliary drive is assigned to the plunger of the press. This auxiliary drive is, in particular, intended to ensure a sufficient plunger force in certain angular position areas of the levers of the elbow lever drive.

DE 10 2007 002 715 A1 discloses an elbow lever drive with two elbow lever drive arrangements which can be operated via a common linear drive which activates the elbow lever joints.

DE 21 27 289 A discloses an adjustable elbow lever drive. A main eccentric drives a main connecting rod which forces the first lever of the elbow lever drive, which first lever is connected to the plunger via a second lever. An auxiliary eccentric acts via an auxiliary connecting rod, one arm of the two-arm lever. The other arm of the two-arm lever is coupled to the elbow joint. The connecting points of the auxiliary connecting rod as well as the drive rod between the two-arm lever and the elbow joint are adjustable. In this way it becomes possible to adjust the impact speed of the plunger on the workpiece, the travel distance of the plunger stroke, the stroke length and the position of the lower reversal point.

Another press with an elbow lever drive is described in DE 198 46 951 A1. The first lever of the elbow lever drive is supported on the press frame whereas the other lever is connected to the plunger. The two levers are interconnected by way of a triangular link so that the first lever and the second lever are connected to the triangular link so as to be pivotable about spaced pivot axes. The triangular link is furthermore connected to an eccentric drive. The length of the arm, the triangular link which is connected to the eccentric drive, can be changed. When the elbow lever drive pivots through its stretched position, the plunger is moved, because of the kinematics of the arrangement, twice through a lower reversal point shortly after one another. The position of these two lower reversal points differs with respect to a reference point on the press frame. If the elbow lever drive does not pivot through its stretched position, a manual about sine-shaped plunger position path is obtained.

This arrangement has the disadvantage that the positions of the low reversal points are different when the elbow drive is moved through its lower stretched position. On the other hand, a changing connecting rod length is in many cases undesirable. A connecting rod of finite length causes at its drive end always a distance-time course which is not identical with a sine or cosine shape. These deviations from a sine or cosine shaped course of movement change if the length of the connecting rod changes. The shorter the connecting rod the greater is the deviation from the sine- or respectively cosine form. Furthermore, the length change of the connecting rod, if to be provided by a control drive, is expensive in its design and increases the moving mass noticeably.

Based on this state of the art, it can be considered to be the object of the invention to provide a press drive and a method for operating such a press drive which ensures a very simple and cost-effective design and which provides at the same time for high flexibility in the use of the press.

SUMMARY OF THE INVENTION

The object is solved by a press drive with the features of the present invention as set forth in the patent claims.

In accordance with the invention, the press drive has an elbow lever drive with a first lever and a second lever which are pivotally joined at an elbow joint. At the elbow joint, the two levers from a common pivot axis. The first lever is supported on a first support bearing of the press frame of the press. The second lever is connected by a second support bearing on the plunger of the press. At the elbow joint, the drive end of a connecting rod is pivotally supported, wherein in particular the two levers and the connecting rod form a common pivot axis at the elbow joint. The end of the connecting rod opposite the drive end is supported on an eccentric of an eccentric drive. Upon rotation of the eccentric, the connecting rod moves the elbow joint and thereby causes a back and forth movement of the plunger. For adjusting the press drive to different operating types, an adjustment arrangement for moving or particularly linearly displacing the eccentric relative to the first support bearing is provided. The adjustment arrangement preferably includes a linear drive. The eccentric is preferably movable linearly in an adjustment direction. Herewith, the position of the eccentric axis of the eccentric or, respectively, the eccentric drive changes with respect to the first support bearing arrangement on the press frame. By this movement of the eccentric different operating modes of the press drive can be set. The position of the eccentric can, for example, be so adjusted that the elbow lever drive moves through its stretched position. In another operating mode the elbow lever joint is not moved through a line which extends between the first and the second support bearing. The elbow joint is then so to say only folded in one direction. In this case, the angle between the two levers of the elbow lever drive at which the connecting rod is arranged is either maximally 180° or always at least 180°. Additional variations of the operating mode settable by the adjusting arrangement can be realized by driving the eccentric either in a reversing mode or in a rotating mode. In the reversing mode, the angular range of the oscillating eccentric may be variably determined with respect to its position and size.

The elbow lever drive has preferably only three levers: the first lever, the second lever and the connecting rod. No further levers are provided. In addition, the press drive has preferably a single eccentric drive. In this way, a simple set-up with few elements is achieved.

The eccentricity of the eccentric of the eccentric drive is in particular constant. The length of the two levers and the length of the connecting rod are, in particular, also constant. The operating modes of the press drive are set by the position of the eccentric relative to the first support bearing and the control of the eccentric drive.

The control arrangement can displace the eccentric and preferably the whole eccentric drive in an adjustment direction. The adjustment direction is preferably linear and may also be oriented transverse that is inclined or at a right angle with respect to a straight line extending through the first support bearing and the second support bearing. Alternatively, the adjustment direction may also be parallel to this line. Another variation can be realized in that the adjustment direction is not linear, but follows a curved course, for example, a circle section. Preferred, however, is a linear displacement of the eccentric or respectively, the eccentric drive by means of a linear drive of the adjustment arrangement.

The length of the adjustment distance on the adjustment direction is preferably greater than the eccentricity of the eccentric. In this way, it is ensured that at least one operating mode can be adjusted by the adjustment arrangement wherein the elbow joint moves with one rotation of the eccentric through the stretched position of the elbow lever drive, as well as, another operating mode in which the elbow joint can reach the stretched position, but is not moved through the stretched position of the elbow lever drive.

The different operating modes for the press drive are provided in a preferred embodiment by a control unit. Preferably, the control unit controls the adjustment arrangement in such a way that it is possible to switch between at least two operating modes by a movement or displacement of the eccentric.

In a further advantageous embodiment, the control unit controls an electric motor of the eccentric drive. The electric motor can be in the form of a servomotor or a torque-motor, particularly an asynchronous motor. For the control of the asynchronous motor, the control unit includes in particular a DC/AC converter.

It is advantageous if, in one operating mode, the eccentric is driven in a predetermined angular range in a back and forth movement that is an oscillating mode. The angular range is in particular smaller than 180°. In this operating mode, large stroke numbers can be achieved. The production rate is high. Such an operation is suitable, for example, for punching, cutting or stamping operations. The control unit may be programmed for different operating modes with an oscillating driven eccentric wherein a different angular range is assigned to each operating mode. Assuming that the vertical position of the eccentric corresponds to the zero degree position, a first angular range for the oscillating driving of the eccentric may, for example, be an angle of between 270° and 300° on one end and an angle of 60° to 90° at the other. That is the eccentric oscillates around its 0° position. In another operating mode, the angular range may be limited between an angular range of, for example, 0° and 30° at one end and an angle of 150° to 180° at the other end. As a result, the eccentric oscillates about its 90° position. Not only the position, but also the size of the angular range may be different in different modes of operation. As a result, the application-dependent operating modes can be adjusted for a large stroke number and/or large opening stroke and/or large plunger force or/respectively press force.

It is also possible to drive the eccentric in at least one operating mode in a rotating fashion. The control unit may be programmed to select on the basis of predetermined or collected operating data a pre-set operating data, a pre-set operating mode or to set an operating mode calculated on the basis of operating data. The operating data comprise in particular one or several of the following information points:

- type of the machining, for example, punching, stamping, bending, deep drawing, extrusion molding, cutting, etc.;
- transfer time required for insertion and/or removal of a workpiece into or, respectively, out of the press;
- production volume that is the number of workpieces to be handled per time unit;
- position and/or part of the operating distance of the plunger in a plunger stroke;
- plunger or respectively, press force;
- etc.

One or several of these operating data may be entered, for example, by an operator via an input arrangement which then transmits these data to the control unit. In addition, or alternatively, one or several of those data may be determined by sensors of the press automatically and be transmitted to the control unit. In particular, with the first installation of the press operation, at least one sample workpiece may be machined in a test operation and the sensor data determined in the process may be transmitted to the control unit as operating data. The control unit, then may, based on the entered and/or determined operating data determine itself a suitable operating mode or select one of the predetermined operating modes. For the selection, optimizing criteria may be taken into consideration, such as, energy efficiency or lubrication of the bearings of the elbow lever drive by the selected bearing movement, the opening stroke, the production volume, etc. Furthermore, the operating data entered by the operator may be checked for reasonability and an error signal may be issued if the data entered cannot be achieved in any operating mode.

BRIEF DESCRIPTION OF THE DRAWINGS

Advantageous embodiments of the invention are apparent from the dependent claims and the description. The description is limited to the essential features of the invention, as shown in the accompanying drawings on the basis of which exemplary embodiments of the invention are explained.

It is shown in.

DETAILED DESCRIPTION OF THE INVENTION

Figure 1:
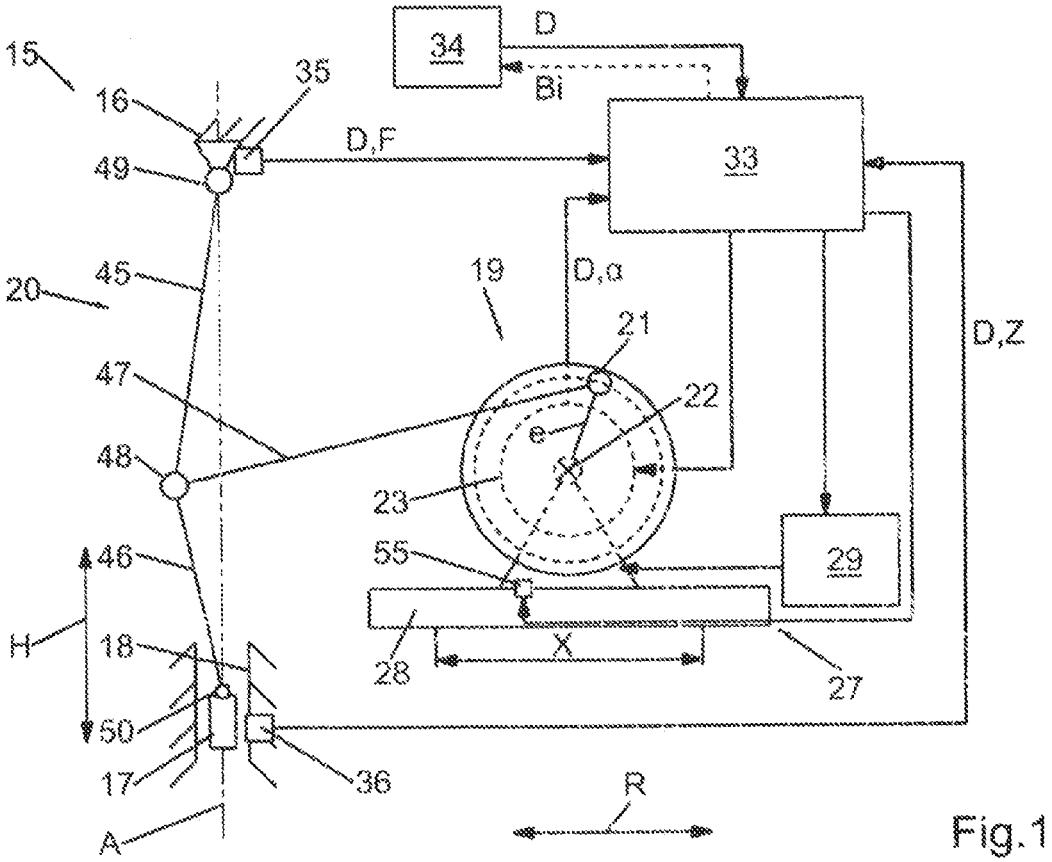
FIG. 1 a block diagram representation of an exemplary embodiment of a press drive for a press.

FIGS. 1 to 4 show a press drive 15 for a press in the form of a block diagram. The press drive 15 is arranged on a press frame 16, which is shown in the figure only symbolically. The press may be provided for various applications or uses, for example, for separating or forming workpieces. The press accordingly is suitable for types of operation such as deep drawing, extrusion molding, bending, cutting, punching, stamping, etc.

The press drive 15 is designed to move the plunger 17 in a stroke direction H. The plunger 17 is supported so as to be guided in the stroke direction H. The guide means 18 may be connected to the press frame 16 and/or a press table of the press. The press drive 15 includes an eccentric drive 19, which is coupled to the plunger 17 by a drive, for example, an elbow lever drive 20. The rotating or oscillating movement of an eccentric 21 of the eccentric drive 19 around an eccentric axis 22 is converted by the elbow lever drive 20 into a back and forth movement of the plunger 17 in the stroke direction H.

The eccentric 21 is rotatable about the eccentric axis 22 by a drive motor which, in the exemplary embodiment is an electric motor 23. The electric motor 23 is in the form of a servomotor or a torque motor, for example, an asynchronous machine. The eccentricity e of the eccentric 21 is unchangeable.

The eccentric 21 and, as shown in the example, the eccentric drive 19 is supported so as to be slidable by an adjustment arrangement in an adjustment direction R. In the exemplary embodiment described herein the adjustment direction R is in a straight line oriented in particular at an angle or at a right angle with respect to the stroke direction. In a modified embodiment, the adjustment direction R may also extend parallel to the stroke direction H. The adjustment arrangement 27 includes a guide arrangement 28 which is arranged at the press frame 16. By means of the guide arrangement 28, the eccentric drive 19 is supported on the press frame 16 movably in the adjustment direction R. For moving the eccentric drive 19 in the adjustment direction R an adjustment arrangement drive 27 is provided which, in the exemplary embodiment, is a linear drive. Alternatively, it may be another drive, in particular an electric adjustment drive 30. As linear drive 29, for example, a spindle drive or a linear motor may be used. The linear drive 29 is preferably in the form of an electric linear drive.

Figure 7:
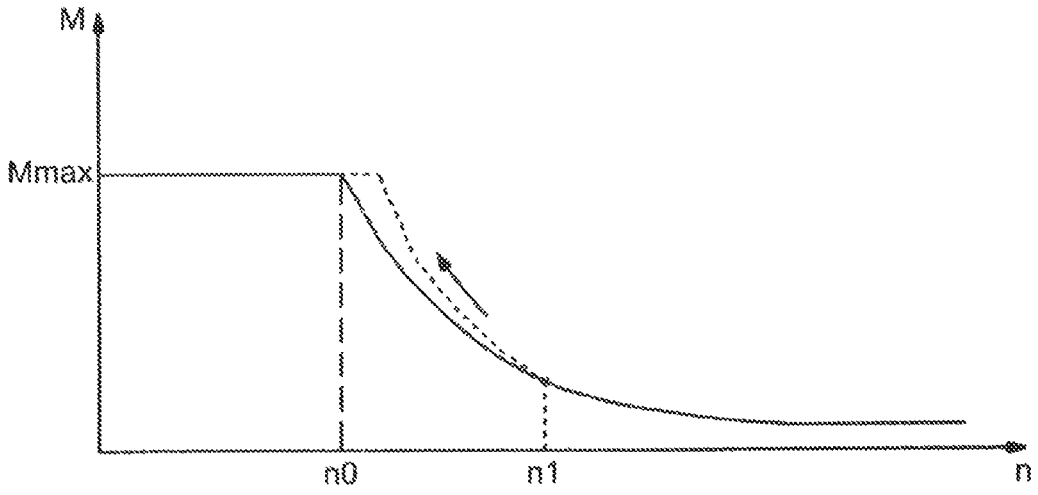
FIG. 7 the relationship between the rotational speed and motor torque of an electric motor of the eccentric drive for the press drive according to FIG. 1.

For controlling the eccentric drive 19 and, in particular, the electric motor 23 for controlling the adjustment arrangement 27 and, in particular, the linear drive 29, a control unit 33 is provided. Via the control unit 33, the electric motor 23 of the eccentric drive 19 can be energized to rotate the eccentric drive or to cause an oscillation of the eccentric drive over a predetermined angular range W. In addition, the speed of the electric motor 23 n (rpm) and or its torque M can be controlled by the control unit 33. FIG. 7 shows schematically, an exemplary curve representing the relationship between the speed n and the torque M of the electric motor by a full line. The maximum torque Mmax is present at low speeds that is at a number of a revolution threshold value nO. For speeds greater than the number of revolution threshold value nO the available torque M drops.

The control unit 33 can address the adjustment arrangement 27 for moving the eccentric drive 19. In particular, the linear motor 29 is activated so that the eccentric drive 19 is moved along the guide arrangement 28 in the adjustment direction R. The adjustment length x available is greater than the eccentricity e of the eccentric 21.

Depending on the position of the eccentric drive 19 along the adjustment length x the control unit 33 can switch the press drive 15 to different operating modes B. In the exemplary embodiment described herein at least two or three operating modes B1, B2, B3 can be selected by the positioning of the eccentric drive 19. The setting of the different operating modes by displacing the eccentric drive 19 is independent of the operating mode of the electric motor 23 of the eccentric drive 19. By changing the operating mode of the eccentric drive 19, the number of operating modes B can be further increased.

In the control unit 33 various operating modes B may be stored. To each operating mode B, a position x1, x2, x3 along the adjustment path of the eccentric drive 19 is assigned as well as the respective control of the eccentric drive. Depending on the machining task of the press, a suitable predetermined operating mode B can be selected by the control unit 33 or, alternatively, a new, or respectively changed operating mode B may be applied and stored. By adaptations of already stored operating modes B, new operating modes B may be formed, which may be used for future similar press operating modes and which may therefore be stored in the control unit 33.

For selecting or determining a suitable operating mode B, operating data D are supplied to the control unit 33. The operating data D may at least partially be determined by an operator and entered by an operating arrangement 34. Additionally or alternatively, the operating data D may be determined by sensors and supplied to the control unit 33. For example, a force sensor 35 may be provided which determines directly or indirectly the force applied by the plunger 17 to a workpiece and which transmits a corresponding force signal F, which characterizes the press or respectively, the plunger force, to the control unit 33. In addition, the plunger position Z in the stroke direction H may be determined by a position sensor 36 and transmitted to the control unit 33. The control unit 33 receives furthermore the angle α of the eccentric drive 19 which defines the angular position of the eccentric 21 about eccentric axis 22.

The following information can be made available to the control unit 33 as operating data D in any combination:

- The type of workpiece machining, such as deforming, bending, stamping, deep drawing, extrusion molding, etc.
- The operating travel distance of the plunger 17 within its stroke during which the actual workpiece machining takes place.
- The plunger force generated by the plunger 17 during workpiece machining in particular dependent on the time t or the angle of rotation α.
- The plunger position Z depending on the time t or the angle of rotation α of the eccentric 21.
- The actual angular position α of the eccentric
- The stroke number of the press.
- etc.

In an advantageous embodiment at least one sample stroke is performed on a sample workpiece and the operating data D are detected by sensors at least partially and transmitted to the control unit 33. The control unit 33 can subsequently select a suitable operating mode B out of the prerecorded operating modes B. The procedure, in principle, is shown in the block circuit representation of FIG. 5. First, the operating data a are determined by the operating arrangement 34 and/or the sensors 35, 36. Based on these operating data, then for each predetermined operating mode B1, B2 . . . Bn, it can be examined whether the operating mode of the press drive 15 is suitable for operating the press with the particular operating data D (first block 40). In a subsequent second block 41, a particular operating mode Bi can then be selected. In the second block 41 for the selection of the operating mode Bi at least one optimizing criterion OK can be taken into consideration, for example, the output of the press, that is the number per time unit of workpieces handled, the minimum electric energy consumption of the eccentric drive, the optimal lubrication of the bearings of the elbow lever drive 20, etc. Whether in the second block 41 an optimizing criterion or several optimizing criteria can be considered depends on whether there is still a degree of freedom available. The fewer operating data D that are predetermined as being necessary, the more degrees of freedom remain available in the second block 49 for the selection of an operating mode.

Figure 5:
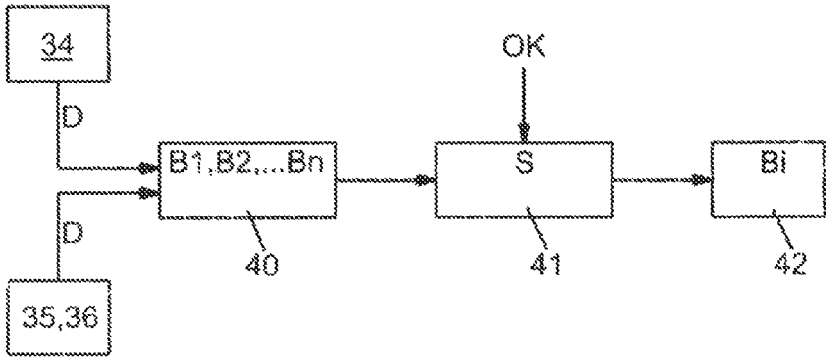
FIG. 5 a block diagram of an exemplary embodiment of a method for operating the press drive according to FIG. 1.

In the third block 42, the selected operating mode Bi is either directly used for the operation of the press drive 15 or it is proposed to the operator via the operating arrangement 34 which then may acknowledge the proposal, and modify or reject it. The course as shown in FIG. 5 can therefore also be performed iteratively in several loops until finally an operating mode Bi for operating the press drive 15 has been selected.

It is also possible to compare the operating data D determined during a provisional operation by sensors with the operating data D determined by an operator and to examine the reasonability. It can be examined, for example, based on the sensor-collected data D whether the production numbers desired by an operator can be achieved by the press. If the operator enters excessive production numbers, which can not be achieved, this is indicated to the operator and/or a proposal for a suitable operating mode Bi is submitted which the operator can accept or modify. In this way, it is insured that faulty adjustments can be recognized and avoided.

If sufficient sensorically determined operating data ID are available, operator involvement is not needed and a suitable operating mode Bi can be automatically selected and used for operating the press drive 15.

In the exemplary embodiment described herein, the elbow lever drive 20 has only three levers: a first lever 45, a second lever 46 and a connecting rod 47 which are supported by a common elbow joint 48 pivotably about a common pivot axis. The first lever 45 is furthermore pivotally connected to the press frame 16 by a first support bearing 49. The support bearing 49 is firmly mounted to the press frame 16. The second lever 46 is connected to the plunger 17 by a second support bearing 50. An axis A extends through the first support bearing 49 and the second support bearing 50. The lengths of the two levers 45, 46, as well as the length of the connecting rod 47 are constant. In the exemplary embodiment described herein, the axis A is oriented in the stroke direction H.

Figure 2:
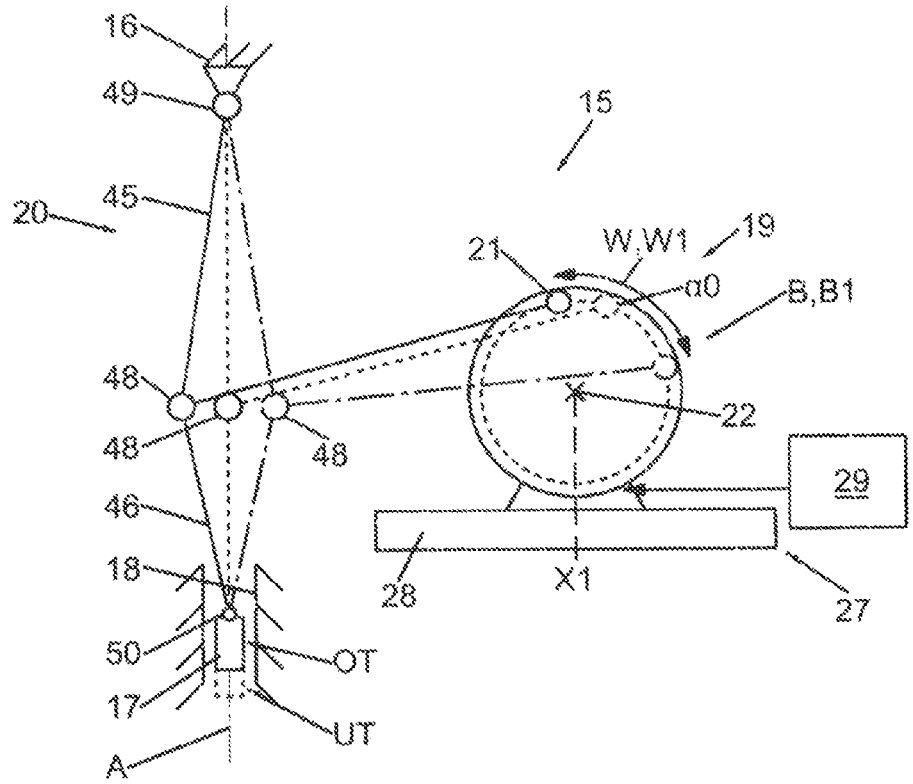
FIG. 2 a block diagram-like representation of a first operating mode of the press drive according to FIG. 1.
Figure 3:
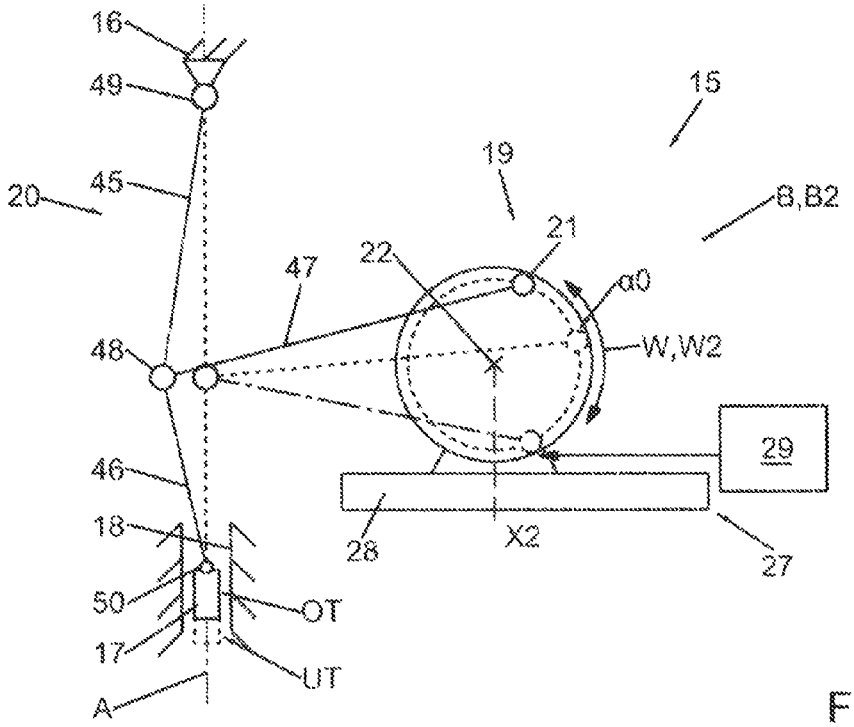
FIG. 3 a block diagram-like representation of a second operating mode for a press drive according to FIG. 1.
Figure 4:
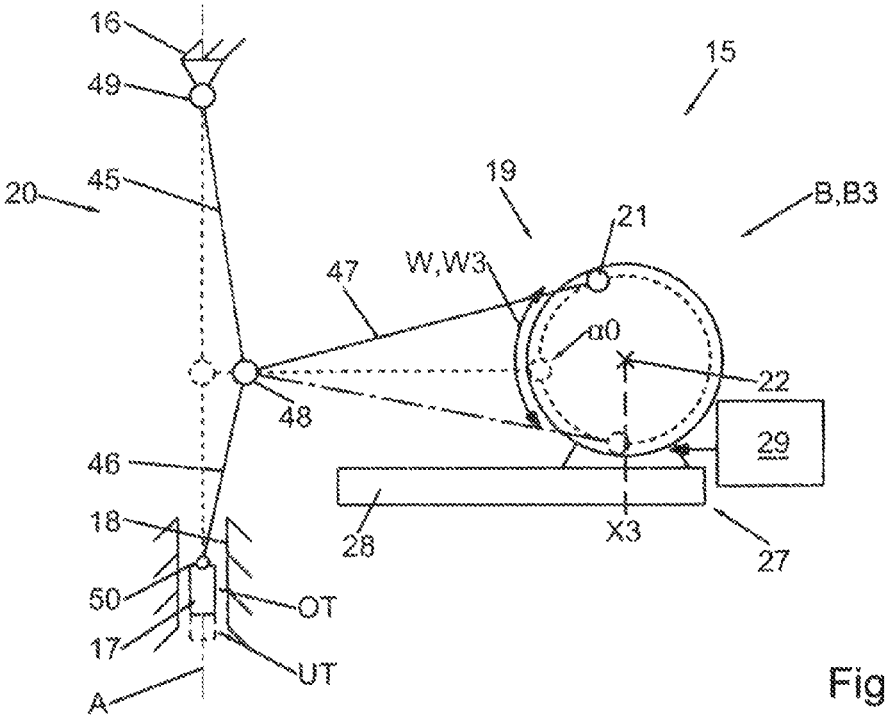
FIG. 4 a block diagram-like representation of a third operating mode for the press drive according to FIG. 1.

FIGS. 2 to 4 show schematically a first operating mode B1, a second operating mode B2, and a third operating mode B3. For clarity, the sensors 35, 36, the control unit 33 and the operating arrangement 34 are not shown in these representations. But these are not other exemplary embodiments of the press drive 15, but only simplified representations.

FIG. 2 shows the first mode of operation B1. The eccentric drive 19 is shown in a first position x1 along the adjustment path x. This first position x1 is so selected that upon rotation of the eccentric 21, the elbow joint 48 or, respectively, the elbow lever drive 20 moves through the stretched position. In the stretched position, the first lever 45 and the second lever 46 extend along the axis A which passes through the first support bearing 49 and the second support bearing 50. This position is shown in FIG. 2 by a dashed line.

Figure 6:
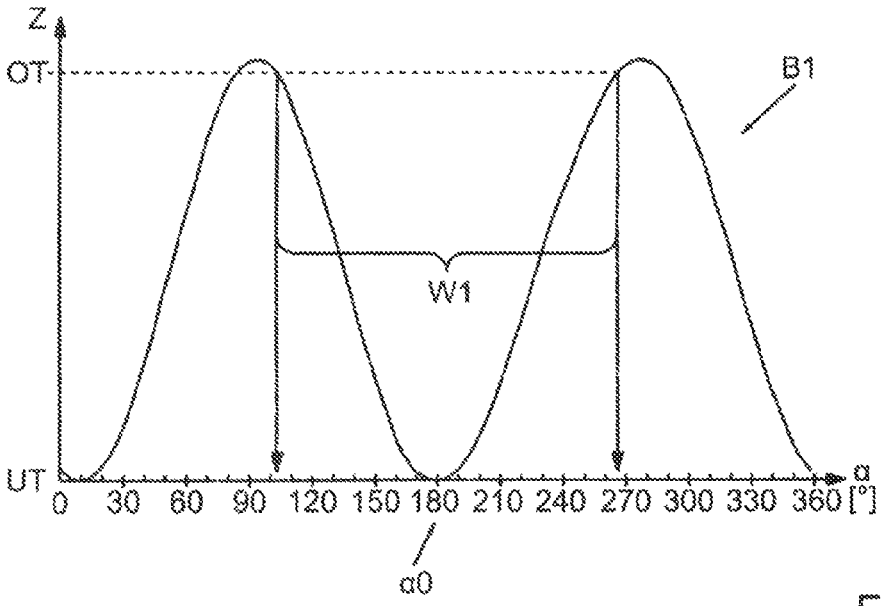
FIG. 6 the stroke of the plunger depending on the angle of rotation of the eccentric drive according to FIG. 1.

The eccentric drive 19 is controlled in the first mode of operation B1 in such a way that the eccentric 21 oscillates in a first angular range W1. In the stretched position of the elbow lever drive 20, the plunger 17 is in its lower reversal point UT, which is also indicated in FIG. 2 by dashed lines. The angle of rotation of the eccentric 21 corresponds to the first angle of rotation when elbow lever drive 20 is in the stretched position and the plunger 17 has reached its bottom reversal point UT. Oscillating about this first angle of rotation, the eccentric 21 is operated in the first angular range W1. Herein it moves either to one or the other side away from the axis A. With a full rotation of the eccentric around the eccentric axis 22, the plunger 17 would reach its bottom reversal point UT twice. The plunger position z depending on the angle of rotation $\alpha$ in the first mode of operation B1 is shown in FIG. 6. The eccentric oscillates in the first angular range W1 around the first angle locations $\alpha$O. Depending on the desired stroke of the plunger 17, the extend of this first angle of rotation range between the lower reversal point UT and the upper reversal point OT may be up to 180°. This depends on whether the available stroke of the plunger 17 is to be fully utilized or whether a smaller stroke, permitting a greater number of strokes, is sufficient. In the first mode of operation B1, stroke numbers of 200 to 300 per minute can be reached, wherein the available stroke length decreases with increasing stroke number.

In this second operating mode B2 (FIG. 3), the eccentric drive 19 is in a second position x2. The second position x2 is so selected that at the first angle location $\alpha$O of the eccentric where the plunger 17 is at its lower reversal point UT, the eccentric has the largest possible distance from the axis A. The connecting rod 47 extends in this case from the eccentric link point through the eccentric axis 22 to the elbow joint 48. In the second operating mode B2, the eccentric drive 19 is so controlled that the eccentric 21 pivots in a second angular range W2 around the first rotational position $\alpha$O. The elbow joint 48 in this case, reaches the axis A in the stretched position of the elbow lever drive 20, but is otherwise always on the opposite side of the eccentric drive 19 as seen from the axis A.

In the third operating mode B3 as shown in FIG. 4, the eccentric drive 19 is in a third position x3 along the adjustment path x. This third position x3 is so selected that at the first rotational angle $\alpha$O, the eccentric 21 is at its minimum distance from the axis A when the plunger 17 is at its lower reversal point UT. At this first rotational angle $\alpha$O, the eccentric axis 22 is disposed in straight alignment with the connecting rod 47. The eccentric 21 pivots in a third angular range W3 around the first rotational angle $\alpha$O. As in the second mode of operation B2, also in the third mode of operation B3, the elbow joint 48 is not moved through the stretched position of the elbow lever drive 20, but maximally reaches the axis A. As seen from the axis A, the elbow joint 48 is always at one side of the axis A on which also the eccentric drive is disposed. That is the elbow joint 48 pivots back and forth starting from the axis A to the eccentric drive 18.

Also in the second and the third mode of operation B2, B3, extent of the respective angular range may be up to 180°.

Additional operating modes B may be adjusted in the described positions x1, x2, x3, in that the eccentric drive 19 is not operated in an oscillating fashion, but alternatively to the described modes of operation, is rotated about eccentric axis 22. The extent of the respective angular range W1, W2, W3 in each mode of operation depends on the required stroke of the plunger 17 and may vary as it has been described in connection with FIG. 6 and the first mode of operation B1. The respective available plunger force or press force is different in the various operating modes B. The amount of torque of the electric motor 23 which can act on the connecting rod 47 and consequently on the elbow joint 48 changes with the rotational angle $\alpha$.

In a variation of the operating modes B2, B3 shown in FIGS. 3 and 4, the angle range W, in which the eccentric 21 pivots about the eccentric axis 22, may also be so selected that the elbow lever drive 20 is always outside the stretched position.

During operation of the press in a mode of operation B, the position of the eccentric drive 19 is not changed by the adjustment arrangement 27. Rather the adjustment arrangement 27 may include a locking means 55 for arresting the eccentric drive 19 in its desired position along the adjustment path x. The arresting means 55 are preferably switchable between a release position in which movement of the eccentric drive 19 along the guide arrangement 28 is permitted and an arrest position in which this movement is blocked or at least inhibited. In the arrest position, furthermore, any play present between the guide arrangement 28 and the eccentric drive 19 may be compensated for so that the eccentric drive is fixed in this position without play. In this way, the plunger position is not compromised by play.

FIG. 7 shows a possibility of controlling the electric motor 23 of the eccentric drive 19. It is assumed that the motor 23 driving the eccentric has a characteristic line shown as a full line between the speed n and the torque M. During working of the workpiece, for example during a deformation procedure, the electric motor 23 can be so controlled that it runs at an initial speed n1 for moving the plunger 17 toward the workpiece. At the beginning of the deformation procedure, the required motor torque M increases since the workpiece resists the movement of the plunger 17. Other than as indicated by characteristic line predetermined by the motor control, the kinetic energy stored in the rotating mass of the eccentric drive 19 can be used to provide for a short-term torque increase as it is indicated in FIG. 7 schematically by this dashed line. Hereby the eccentric drive 19 is decelerated so that the speed n is reduced. However, since this is necessary anyhow, if the torque M required for the deformation is greater than the torque of the motor which is available at the initial speed n1, the rotational energy stored in the eccentric drive 19 can be advantageously utilized.

Figure 8:
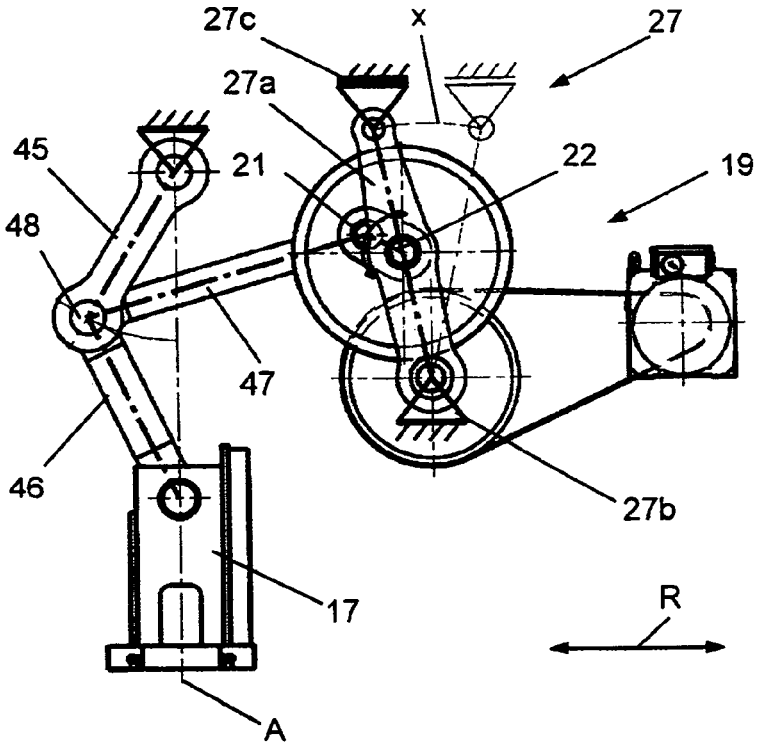
FIGS. 8-13 further schematic representations of exemplary embodiments of a press drive for a press; and, FIG. 14 characteristic curves for an individual stroke of the plunger depending on the angle of rotation of the eccentric drive of the press drive.
Figure 9:
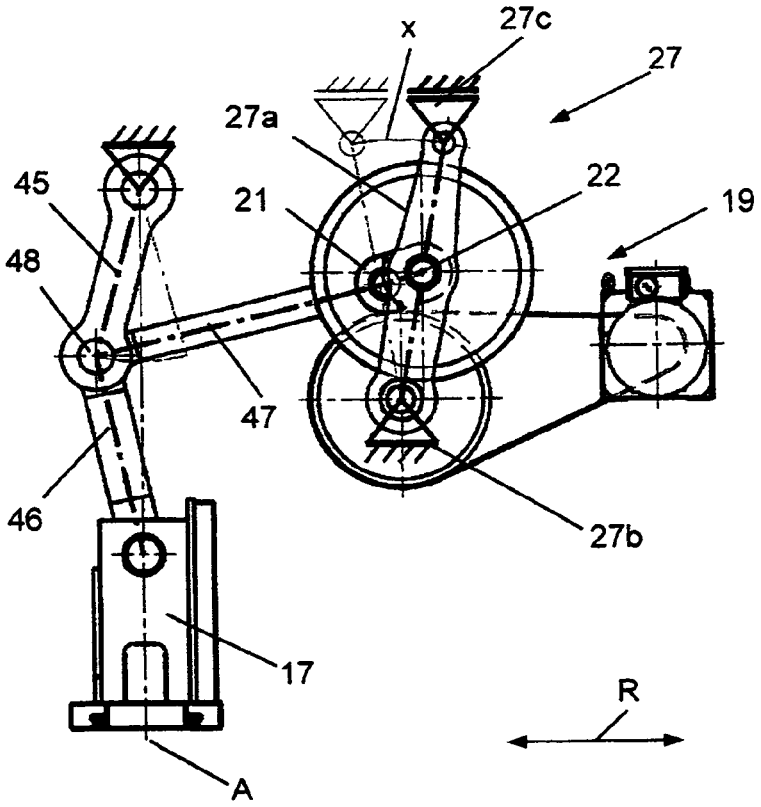

FIG. 8 shows another possible embodiment of the adjustment arrangement 27 for adjusting the eccentric drive 19. The adjustment arrangement 27 comprises an adjustment arm 27*a* on which the eccentric 21 of the eccentric drive 19 is supported. One end of the adjustment arm 27*a* is pivotally connected to a stationary support 27*b* whereas the opposite end is connected to a movable, for example pivotable support bearing 27*c*. With the setting of the respective mode of operation B, the movable support bearing 27*c* is pivoted about the stationary support 27*b*. This results also in an adjustment movement of the eccentric drive 19 in the adjustment direction R. Independent of the path of movement of the eccentric drive 19 or, respectively, the eccentric axis 22 during the displacement thereof, the distance between the axis A and the eccentric axis 22 can be adjusted in all embodiments. FIG. 9 shows the embodiment of FIG. 8 in another position of the eccentric drive 19.

Figure 10:
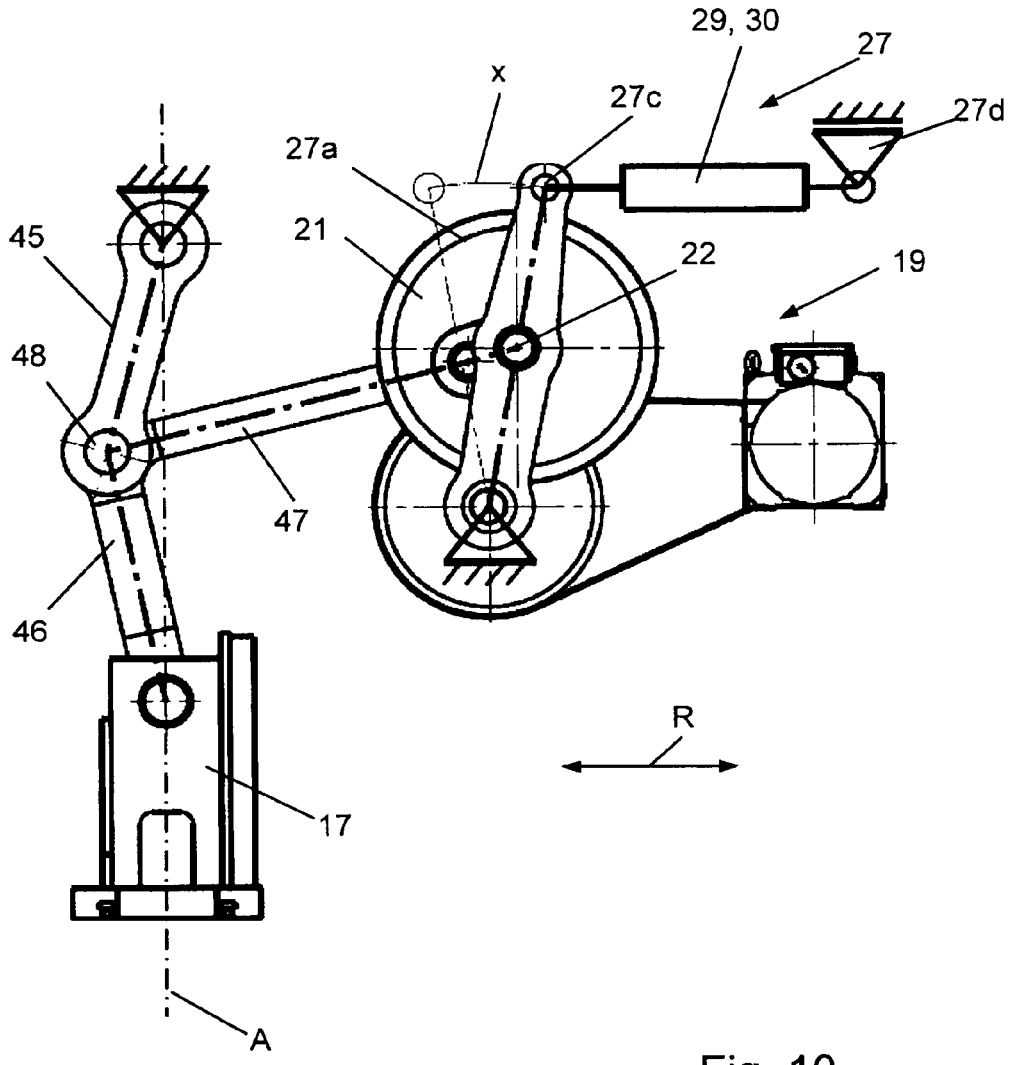

In the exemplary embodiment as shown in FIG. 10, the movable support bearing 27*c* is connected via a linear drive 29 or any other type of adjustment drive 30 to another stationary support 27*d* of the adjustment arrangement 27. Otherwise, this embodiment corresponds to the exemplary embodiment according to FIGS. 8 and 9.

Figure 11:
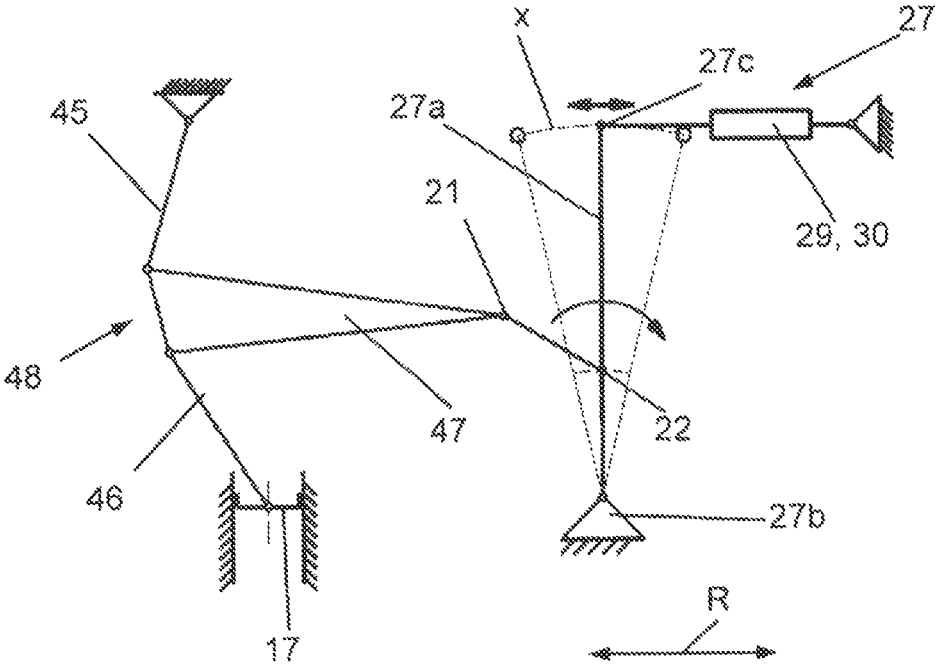

FIG. 11 shows schematically a modified press drive 15 wherein the connecting rod 47 is connected at two different attachment points at one hand to the first lever 45 and at the other to a second lever 46. Otherwise the arrangement corresponds to the exemplary embodiment as shown in FIG. 10.

Figure 12:
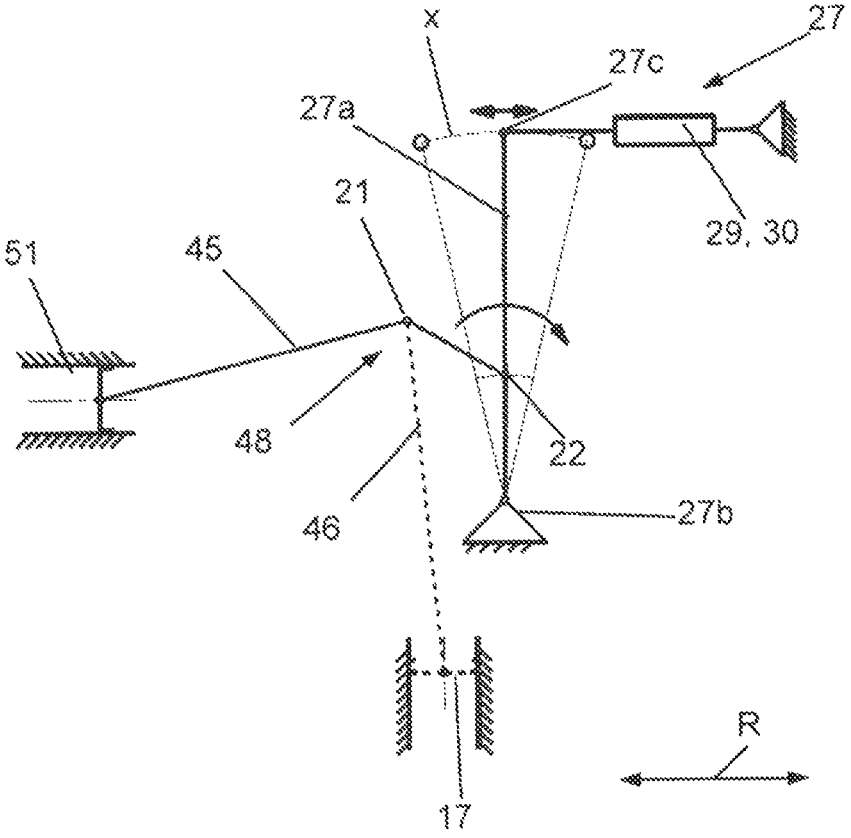

FIG. 12 shows schematically an exemplary embodiment of the press drive 15 wherein the two levers 45 and 46 are each directly connected to the eccentric 21. The connecting rod 47 is so to say shortened to a point. The connecting point of the two levers 45, 46 directly to the eccentric 21 represents consequently an elbow joint 48. The elbow joint 48 moves along a circular path around the eccentric axis 22. The other end of the two levers 45, 46, in each case with the ends opposite the elbow joint 48, is slidably supported. One lever, for example, the second lever 46 is connected to the plunger 17, whereas the other lever 45 is linearly movably supported in a linear friction bearing 51. The linear bearing 51 is in the shown embodiment linearly slidable in the adjustment direction R.

Figure 13:
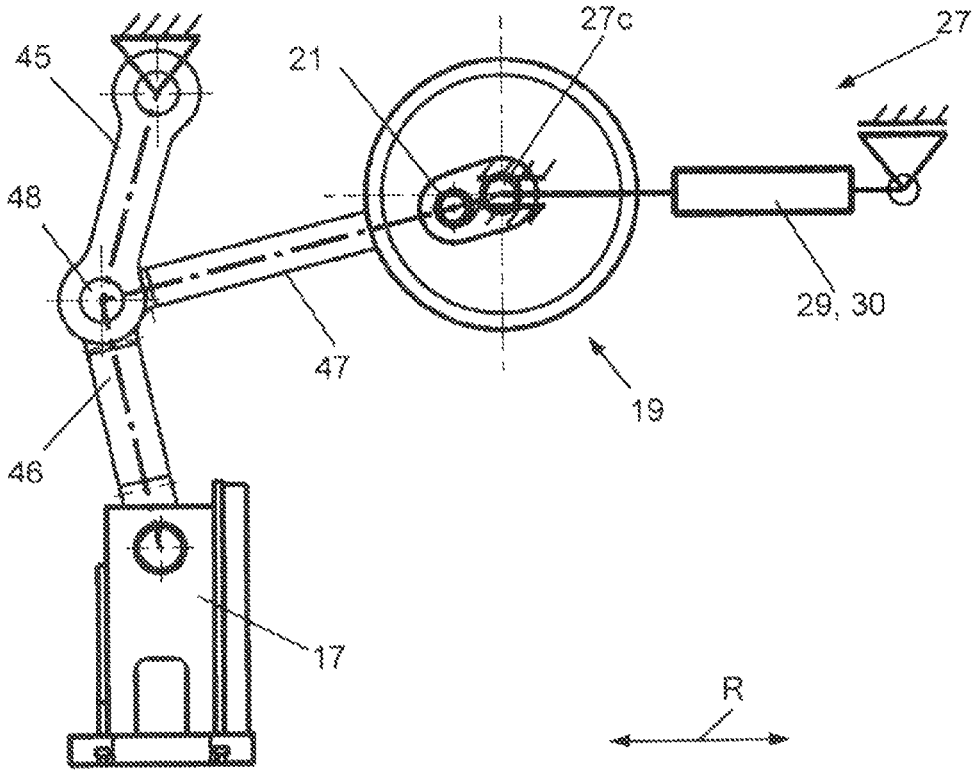

FIG. 13 shows another embodiment of the press drive. The adjustment arrangement 27 includes an adjustment drive 30, for example, a linear drive 29 which can move a support bearing 27*c* which is arranged at the axis of rotation 22 of the eccentric 21 in adjustment direction R. The adjustment drive 30 is consequently connected directly to the movable support bearing 27*c* defining the eccentric axis 22.

Figure 14:
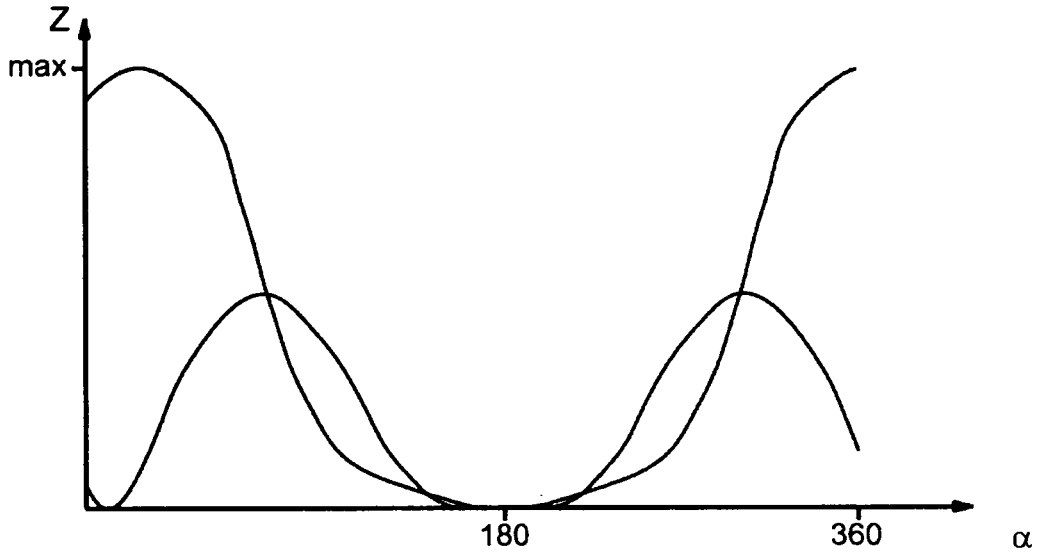

FIG. 14 shows further characteristic lines of the movement of the plunger 17 depending on the angle of rotation $\alpha$. With a particular adjustment of the eccentric axis 22 with respect to the axis A the characteristic plunger lines can be adjusted.

The invention concerns a press drive 15 for a press. The press drive 15 includes an elbow drive 20. The elbow drive includes a first lever 45, a second lever 46 and a connecting rod 47. The length of the two levers 45, 46 and the length of the connecting rod are fixed. The first lever 45 is pivotably supported on the press frame 16 via a first support bearing 49. The second lever 46 is supported on the plunger 17 via a second support bearing 50. The connecting rod 47 and the two levers 45, 46 are supported by an elbow joint 48 so as to be pivotable about a common pivot axis. The connecting rod 47 is driven by an eccentric drive 19. An adjustment arrangement 27 is provided for displacing the eccentric drive 19 relative to the press frame 16 or respectively the first support bearing 49. In this way, different operating modes B1, B2, B3 can be established depending on the position x1, x2, x3 of the eccentric 19 along the adjustment path x.

LISTING OF REFERENCE NUMERALS

15 press drive
16 press frame
17 plunger
18 guide means
19 eccentric drive
20 elbow lever drive
21 eccentric
22 eccentric axis
23 electric motor
27 adjustment arrangement
27*a* adjustment arm
27*b* stationary support
27*c* movable support bearing
27*d* stationary support
28 guide arrangement
29 linear drive
30 adjustment drive
33 control unit
34 operating arrangement
35 force sensor
36 position sensor

40 first block
41 second block
42 third block
45 first lever
46 second lever
47 connecting rod
48 elbow joint
49 first support bearing
50 second support bearing
51 friction bearing
55 locking means
a angular position
A axis
B mode of operation
B1 first operating mode
B2 second operating mode
B3 third operating mode
D operating data
e eccentricity
F force
H stroke direction
R adjustment direction
UT lower reversal point
W angle range
W1 first angle range
x adjustment path
z plunger position

What is claimed is:

1. Press drive (15) for a press, comprising an elbow lever drive (20), which includes a first lever (45) and a second lever (46) which are supported by an elbow joint (48) so as to be pivotable relative to each other, wherein the elbow lever drive (20) has a first support bearing (49) via which the first lever (45) is supported on a press frame (16) and a second support bearing (50) via which the second lever (46) is connected to a plunger (17) of the press;

a connecting rod (47) whose one end is pivotally supported on the elbow joint (48) and whose other end is connected to an eccentric (21) of an eccentric drive (19);

an adjustment arrangement (27) including a guide arrangement (28) operatively arranged on the press frame (16), the guide arrangement (28) operatively supports the eccentric drive (19) which is movable along the guide arrangement (28) in an adjustment direction (R) along an adjustment path (x), the adjustment arrangement (27) for adjusting the eccentric (21) relative to the first support bearing (49), in the adjustment direction (R) along the adjustment path (x), wherein the position of the eccentric axis (22) of the eccentric (21) or, respectively, the eccentric drive (19) may be changed with respect to the first support bearing (49); and, the adjustment arrangement (27) further including a locking means (55) operatively engageable with the guide arrangement (28), the locking means (55) operatively switchable between a release position in which movement of the eccentric drive (19) in an adjustment direction (R) along the adjustment path (x) is permitted and an arrest position in which movement of the eccentric drive (19) in an adjustment direction (R) along the adjustment path (x) is blocked or at least inhibited for bypassing any adjustment by the adjustment arrangement (27) of the eccentric (21) or respectively, the eccentric drive (19) during operation of the press in a mode of operation (B).

2. Press drive (15) according to claim 1, wherein the adjustment arrangement (27) includes a linear drive (29) for linearly displacing the eccentric (21).

3. Press drive (15) according to claim 2, wherein the adjustment direction (R) is oriented transverse to an axis (A) which extends through the first support bearing (49) and the second support bearing (50) or the adjustment arrangement (R) is oriented parallel to the axis (A).

4. Press drive (15) according to claim 3, wherein the adjustment length (x) of the eccentric (21) in the adjustment direction (R) is greater than the eccentricity of the eccentric.

5. Press drive (15) according to claim 1, wherein the press drive (15) includes a control unit (33) for causing movement of the adjustment arrangement (27) thereby setting different operating modes (B) including at least one of a first operating mode (B1) corresponding to an adjustment length position (x1), a second operating mode (B2) corresponding to an adjustment length position (x2), and a third operating mode (B3) corresponding to an adjustment length position (x3) for the press drive (15).

6. Press drive (15) according to claim 5, wherein a switch-over between at least two of the first operating mode (B1), second operating mode (B2), and third operating mode (B3) is possible by displacement of the eccentric (21) by the adjustment arrangement (27).

7. Press drive (15) according to claim 5, wherein in at least one of the different operating modes (B) the eccentric (21) is driven so as to oscillate in a predetermined angular range (W).

8. Press drive (15) according to claim 7, wherein in the different operating modes (B) the angular range (W) is different.

9. Press drive (15) according to claim 5, wherein in at least one of the different operating modes (B) the eccentric is driven so as to rotate.

10. Press drive (15) according to claim 5, wherein in the first operating mode (B1) the elbow joint (48) is moved through an axis (A) which connects the first and the second support bearing (49, 50).

11. Press drive (15) according to claim 5, wherein in the second operating mode (B2) and/or the third operating mode (B3) the elbow joint (48) is moved with respect to an axis (A) interconnecting the first and the second support bearing (49, 50) only in one direction.

12. Press drive (15) according to claim 5, wherein the control unit (33) is for establishing the different operating modes (B) on the basis of predetermined or detected operating data (D).

13. Press drive (15) according to claim 12, wherein the operating data (D) are at least partially detected by at least one of a force sensor (35) and a position sensor (36) and transmitted to the control unit (33).

14. Press drive (15) according to claim 13, wherein the operating data (D) are determined during a test working of a sample workpiece.

15. Press drive (15) according to claim 13, wherein the operating data (D) are at least partially predetermined by an operating arrangement (34) and transmitted to the control unit (33).

16. Press drive (15) according to claim 5, wherein the eccentric drive (19) includes an electric motor (23) which is controlled or regulated by the control unit (33), wherein the control unit (33) uses in the control of the electric motor (23) the energy stored in the rotating mass of the eccentric drive (19) so as to increase the torque (M) provided by the electric motor for a short period.

* * * * *